US009297267B2

(12) United States Patent
Itzel et al.

(10) Patent No.: US 9,297,267 B2
(45) Date of Patent: Mar. 29, 2016

(54) SYSTEM AND METHOD FOR REMOVING HEAT FROM A TURBINE

(71) Applicant: General Electric Company, Schenectady, NY (US)

(72) Inventors: Gary Michael Itzel, Simpsonville, SC (US); Kevin R. Kirtley, Simpsonville, SC (US); Christian Lee Vandervort, Voorheesville, NY (US); Ronald Scott Bunker, Waterford, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 627 days.

(21) Appl. No.: 13/709,306

(22) Filed: Dec. 10, 2012

(65) Prior Publication Data

US 2014/0157792 A1 Jun. 12, 2014

(51) Int. Cl.

| | |
|---|---|
| ***F02G 3/00*** | (2006.01) |
| ***F01D 9/04*** | (2006.01) |
| ***F01D 5/18*** | (2006.01) |
| ***F01D 5/28*** | (2006.01) |

(52) U.S. Cl.

CPC ..... *F01D 9/041* (2013.01); *F01D 5/187* (2013.01); *F01D 5/288* (2013.01)

(58) Field of Classification Search

CPC ..... F01D 9/041; F01D 5/187; F01D 5/288
USPC ..... 60/805, 806; 415/115, 116
See application file for complete search history.

(56) References Cited

U.S. PATENT DOCUMENTS

| | | | | |
|---|---|---|---|---|
| 5,611,197 | A | 3/1997 | Bunker | |
| 6,174,133 | B1 | 1/2001 | Bunker | |
| 6,206,638 | B1 * | 3/2001 | Glynn | F01D 5/186 415/115 |
| 6,261,054 | B1 | 7/2001 | Bunker et al. | |
| 6,528,118 | B2 | 3/2003 | Lee et al. | |
| 6,551,061 | B2 | 4/2003 | Darolia et al. | |
| 6,617,003 | B1 | 9/2003 | Lee et al. | |
| 6,905,302 | B2 | 6/2005 | Lee et al. | |
| 8,651,805 | B2 * | 2/2014 | Lacy et al. | 415/178 |
| 2011/0259017 | A1 * | 10/2011 | Lacy et al. | |
| 2012/0111545 | A1 | 5/2012 | Bunker et al. | |
| 2012/0114868 | A1 | 5/2012 | Bunker et al. | |
| 2012/0114912 | A1 | 5/2012 | Bunker et al. | |
| 2012/0124832 | A1 | 5/2012 | Bunker et al. | |
| 2012/0145371 | A1 | 6/2012 | Bunker et al. | |
| 2012/0148769 | A1 | 6/2012 | Bunker et al. | |
| 2012/0163984 | A1 | 6/2012 | Bunker | |

* cited by examiner

*Primary Examiner* — Ching Chang
(74) *Attorney, Agent, or Firm* — Dority & Manning, PA

(57) ABSTRACT

A system for removing heat from a turbine includes a component in the turbine having a supply plenum and a return plenum therein. A substrate that defines a shape of the component has an inner surface and an outer surface. A coating applied to the outer surface of the substrate has an interior surface facing the outer surface of the substrate and an exterior surface opposed to the interior surface. A first fluid channel is between the outer surface of the substrate and the exterior surface of the coating. A first fluid path is from the supply plenum, through the substrate, and into the first fluid channel, and a second fluid path is from the first fluid channel, through the substrate, and into the return plenum.

20 Claims, 8 Drawing Sheets

SYSTEM AND METHOD FOR REMOVING HEAT FROM A TURBINE

FIELD OF THE INVENTION

The present disclosure generally involves a system and method for removing heat from a turbine. In particular embodiments, the system and method may include a closed-loop cooling system that removes heat from a component along a hot gas path in the turbine.

BACKGROUND OF THE INVENTION

Turbines are widely used in a variety of aviation, industrial, and power generation applications to perform work. Each turbine generally includes alternating stages of peripherally mounted stator vanes and rotating blades. The stator vanes may be attached to a stationary component such as a casing that surrounds the turbine, and the rotating blades may be attached to a rotor located along an axial centerline of the turbine. A compressed working fluid, such as steam, combustion gases, or air, flows along a hot gas path through the turbine to produce work. The stator vanes accelerate and direct the compressed working fluid onto the subsequent stage of rotating blades to impart motion to the rotating blades, thus turning the rotor and generating shaft work.

Higher working fluid operating temperatures generally result in improved thermodynamic efficiency and/or increased power output. However, higher operating temperatures also lead to increased erosion, creep, and low cycle fatigue of various components along the hot gas path. As a result, various systems and methods have been developed to provide cooling to the various components exposed to the high temperatures associated with the hot gas path. For example, some systems and methods circulate a cooling media through internal cavities in the components to provide convective and conductive cooling to the components. In other systems and methods, the cooling media may also flow from the internal cavities, through cooling passages, and out of the components to provide film cooling across the outer surface of the components. Although current systems and methods have been effective at allowing higher operating temperatures, an improved system and method for removing heat from the turbine would be useful.

BRIEF DESCRIPTION OF THE INVENTION

Aspects and advantages of the invention are set forth below in the following description, or may be obvious from the description, or may be learned through practice of the invention.

One embodiment of the present invention is a system for removing heat from a turbine. The system includes a component in the turbine having a supply plenum and a return plenum therein. A substrate that defines a shape of the component has an inner surface and an outer surface. A coating applied to the outer surface of the substrate has an interior surface facing the outer surface of the substrate and an exterior surface opposed to the interior surface. A first fluid channel is between the outer surface of the substrate and the exterior surface of the coating. A first fluid path is from the supply plenum, through the substrate, and into the first fluid channel, and a second fluid path is from the first fluid channel, through the substrate, and into the return plenum.

Another embodiment of the present invention is a system for removing heat from a turbine that includes an airfoil having a leading edge, a trailing edge downstream from the leading edge, and a concave surface opposed to a convex surface between the leading and trailing edges. A substrate that defines at least a portion of the airfoil has an inner surface and an outer surface. A coating applied to the outer surface of the substrate has an interior surface facing the outer surface of the substrate and an exterior surface opposed to the interior surface. A first fluid channel is between the outer surface of the substrate and the exterior surface of the coating. A first fluid path is through the substrate and into the first fluid channel, and a second fluid path is from the first fluid channel and through the substrate.

In yet another embodiment of the present invention, a gas turbine includes a compressor, a combustor downstream from the compressor, and a turbine downstream from the combustor. A substrate that defines at least a portion of the turbine has an inner surface and an outer surface. A coating applied to the outer surface of the substrate has an interior surface facing the outer surface of the substrate and an exterior surface opposed to the interior surface. A first fluid channel is between the outer surface of the substrate and the exterior surface of the coating. A first fluid path is through the substrate and into the first fluid channel, and a second fluid path is from the first fluid channel and through the substrate.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
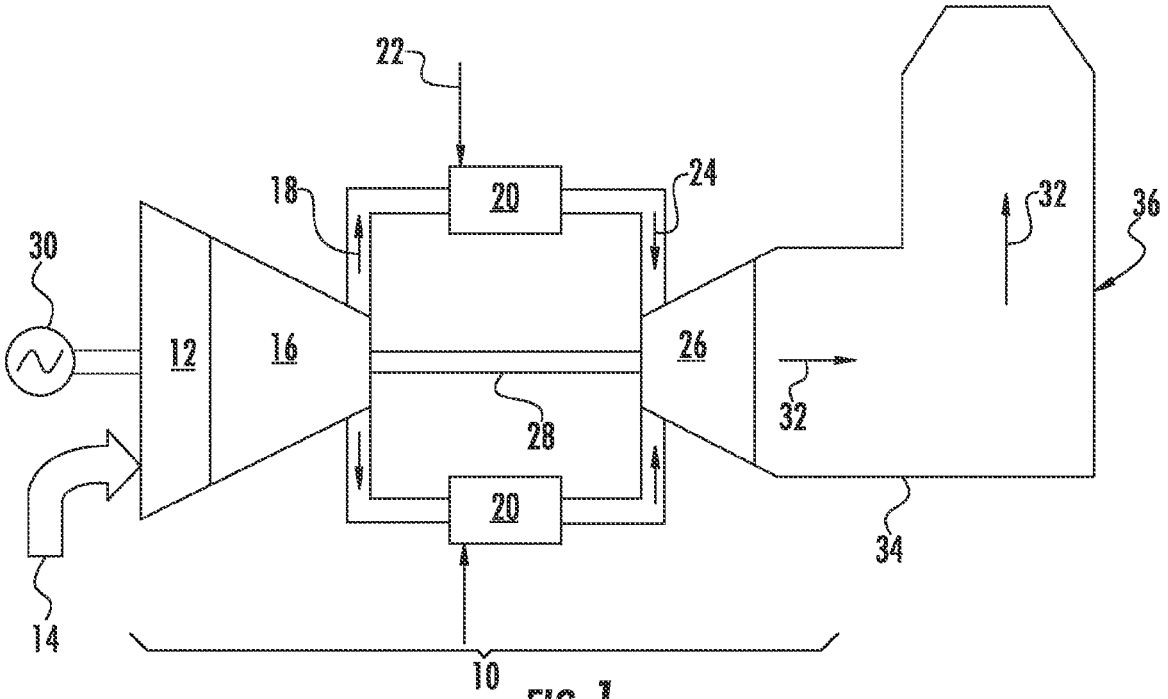
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for removing heat from a turbine. The systems and methods generally include one or more fluid channels embedded in an outer surface of a component located along a hot gas path in the turbine. In particular embodiments, the fluid channels may be embedded in a substrate that defines a shape of the component, while in other embodiments, the fluid channels may be embedded in or surrounded by one or more coatings applied to the substrate. A cooling media may be supplied to the component through a supply plenum to flow through the fluid channels before flowing through a return plenum without being exhausted into the hot gas path. In this manner, the systems and methods described herein provide a closed-loop cooling circuit to conductively and/or convectively remove heat from the component. Although various exemplary embodiments of the present invention may be described in the context of a turbine incorporated into a gas turbine, one of ordinary skill in the art will readily appreciate that particular embodiments of the present invention are not limited to a turbine incorporated into a gas turbine unless specifically recited in the claims.

Referring now to the drawings, wherein identical numerals indicate the same elements throughout the figures, FIG. 1 provides a functional block diagram of an exemplary gas turbine 10 within the scope of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor 16, and the compressor 16 progressively imparts kinetic energy to the working fluid 14 to produce a compressed working fluid 18 at a highly energized state. The compressed working fluid 18 flows to one or more combustors 20 where it mixes with a fuel 22 before combusting to produce combustion gases 24 having a high temperature and pressure. The combustion gases 24 flow through a turbine 26 to produce work. For example, a shaft 28 may connect the turbine 26 to the compressor 16 so that rotation of the turbine 26 drives the compressor 16 to produce the compressed working fluid 18. Alternately or in addition, the shaft 28 may connect the turbine 26 to a generator 30 for producing electricity. Exhaust gases 32 from the turbine 26 flow through a turbine exhaust plenum 34 that may connect the turbine 26 to an exhaust stack 36 downstream from the turbine 26. The exhaust stack 36 may include, for example, a heat recovery steam generator (not shown) for cleaning and extracting additional heat from the exhaust gases 32 prior to release to the environment.

Figure 2:
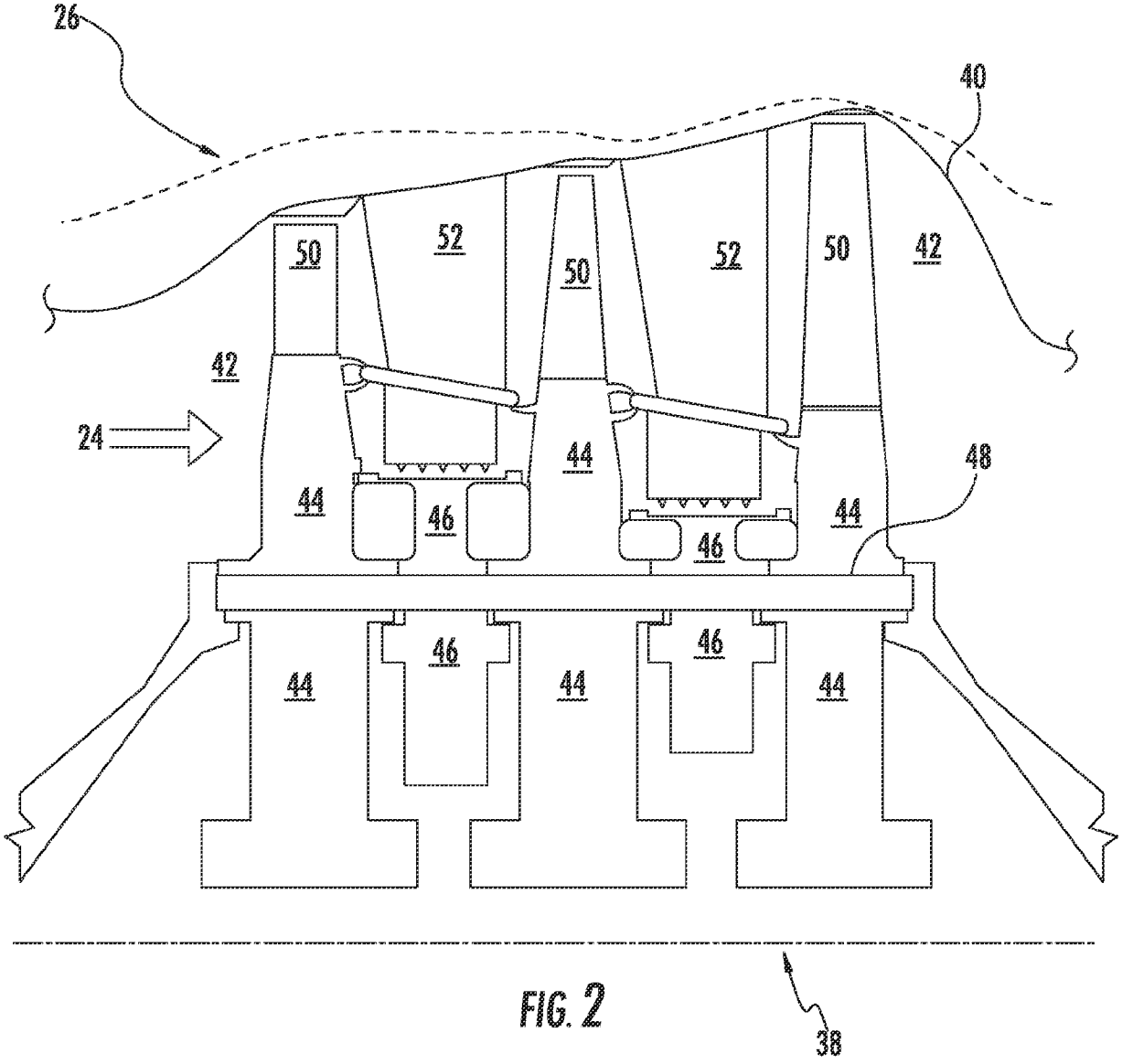
FIG. 2 is a simplified side cross-section view of a portion of an exemplary turbine that may incorporate various embodiments of the present invention.

FIG. 2 provides a simplified side cross-section view of a portion of the turbine 26 that may incorporate various embodiments of the present invention. As shown in FIG. 2, the turbine 26 generally includes a rotor 38 and a casing 40 that at least partially define a hot gas path 42 through the turbine 26. The rotor 38 may include alternating sections of rotor wheels 44 and rotor spacers 46 connected together by a bolt 48 to rotate in unison. The casing 40 circumferentially surrounds at least a portion of the rotor 38 to contain the combustion gases 24 or other compressed working fluid flowing through the hot gas path 42. The turbine 26 further includes alternating stages of rotating blades 50 and stationary vanes 52 circumferentially arranged inside the casing 40 and around the rotor 38 to extend radially between the rotor 38 and the casing 40. The rotating blades 50 are connected to the rotor wheels 44 using various means known in the art, and the stationary vanes 52 are peripherally arranged around the inside of the casing 40 opposite from the rotor spacers 46. The combustion gases 24 flow along the hot gas path 42 through the turbine 26 from left to right as shown in FIG. 2. As the combustion gases 24 pass over the first stage of rotating blades 50, the combustion gases 24 expand, causing the rotating blades 50, rotor wheels 44, rotor spacers 46, bolt 48, and rotor 38 to rotate. The combustion gases 24 then flow across the next stage of stationary vanes 52 which accelerate and redirect the combustion gases 24 to the next stage of rotating blades 50, and the process repeats for the following stages. In the exemplary embodiment shown in FIG. 2, the turbine 26 has two stages of stationary vanes 52 between three stages of rotating blades 50; however, one of ordinary skill in the art will readily appreciate that the number of stages of rotating blades 50 and stationary vanes 52 is not a limitation of the present invention unless specifically recited in the claims.

Figure 3:
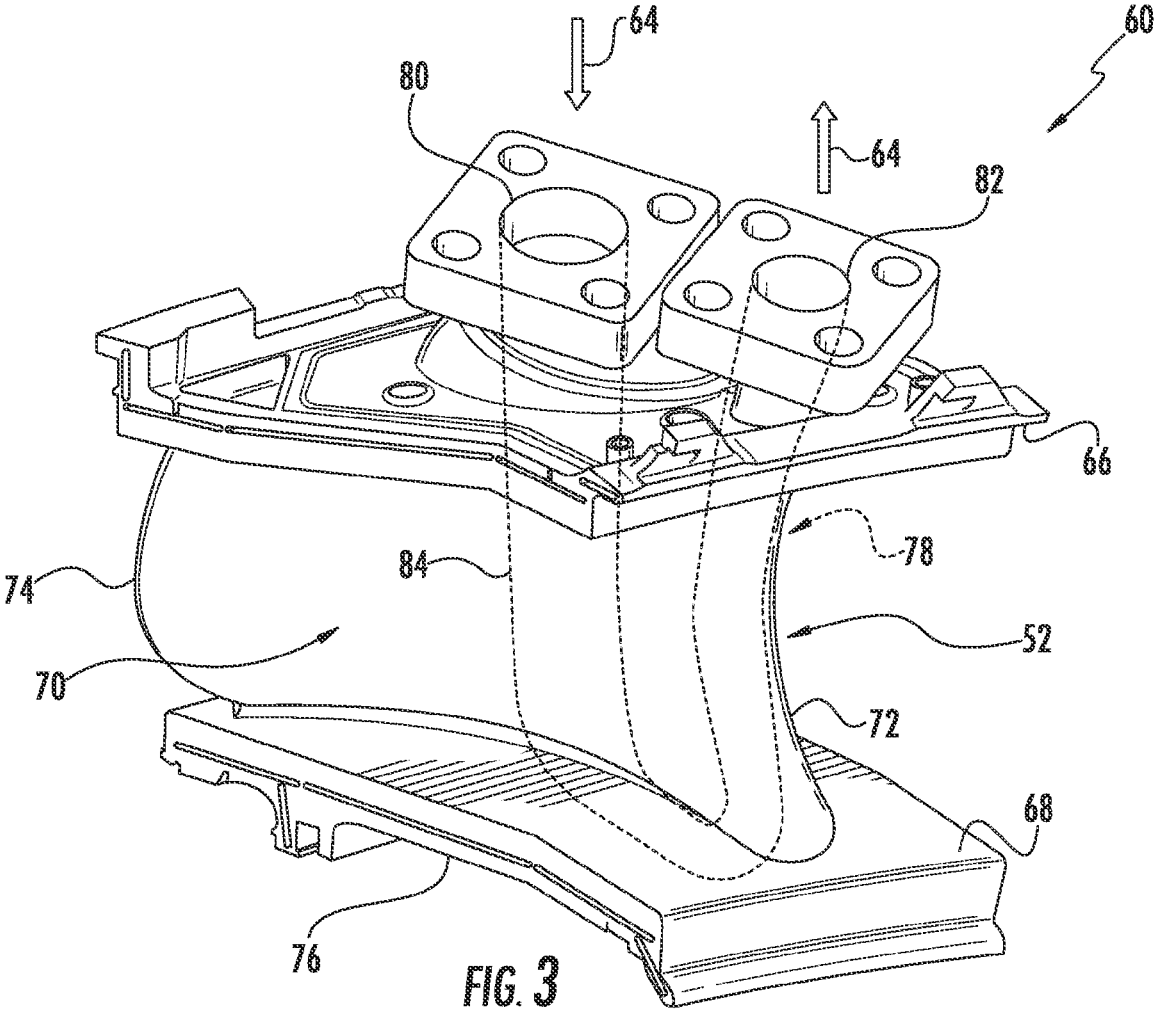
FIG. 3 is perspective view of a system for removing heat from the turbine according to one embodiment of the present invention.
Figure 4:
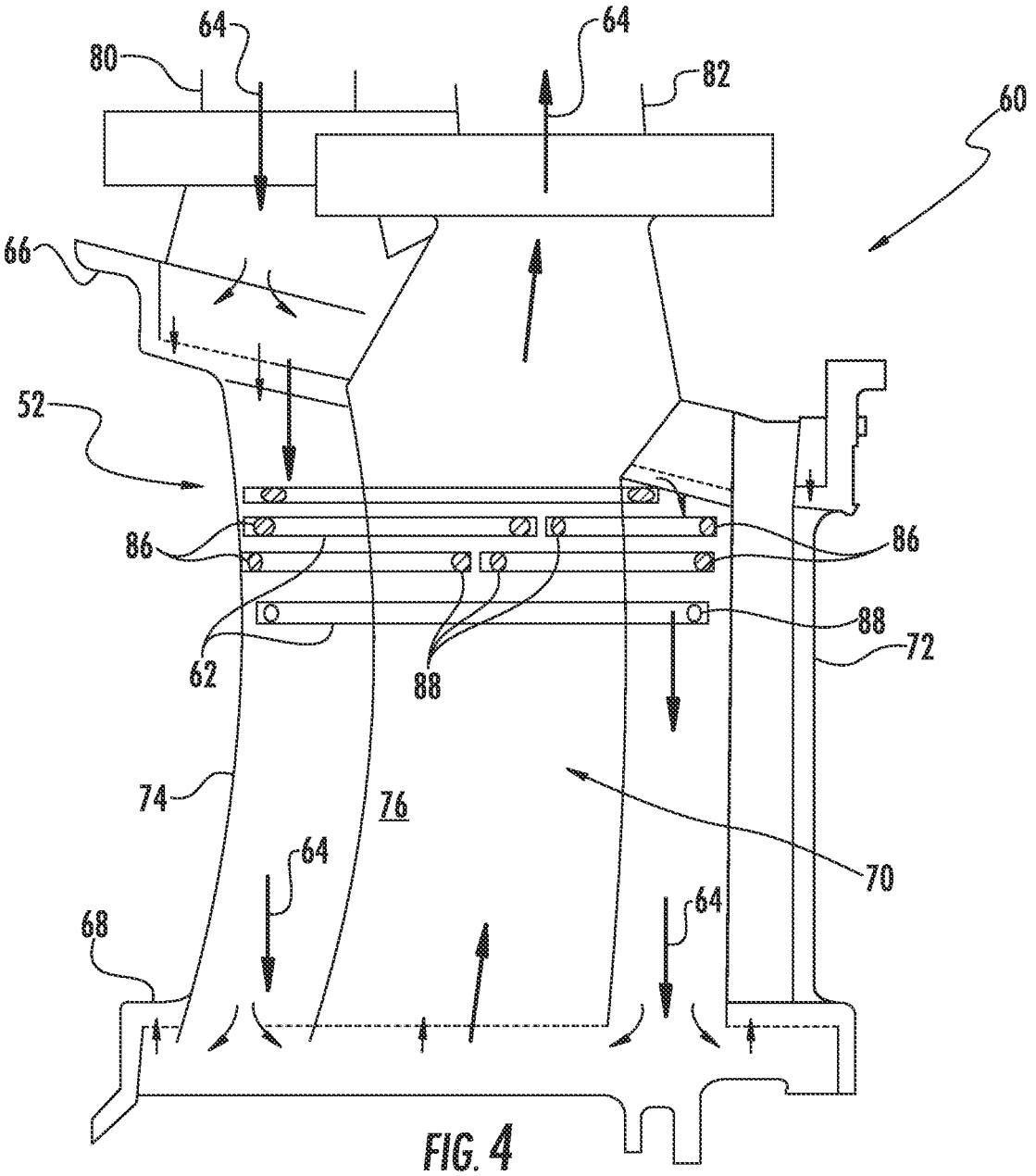
FIG. 4 is a plan view of the system shown in FIG. 3 with exemplary fluid channels and cooling media flow.

FIG. 3 provides a perspective view of a system 60 for removing heat from the turbine 26 according to one embodiment of the present invention, and FIG. 4 provides a plan view of the system 60 shown in FIG. 3 with exemplary fluid channels 62 and cooling media flow 64. The system 60 generally provides closed-loop cooling to any component exposed to the hot gas path 42. The cooling media 64 supplied by the closed-loop cooling may include, for example, compressed working fluid 18 diverted from the compressor 16, saturated or superheated steam produced by the regenerative heat exchanger (not shown), or any other readily available fluid having suitable heat transfer characteristics (e.g., conditioned and delivered from an off-board system). The cooling media 64 flows through the fluid channels 62, also known generically as micro-channels, in the outer skin of the components to convectively and/or conductively remove heat from the outer surface of the components. The fluid channels 62 may have various shapes, sizes, lengths, and widths, depending on the particular component being cooled. For example, the fluid channels 62 may have any geometric cross-section, may range in diameter from approximately 0.0005-0.05 inches, and may extend inside the outer skin of the components horizontally, diagonally, or in serpentine directions (i.e., radially), depending on the particular embodiment. After flowing through the fluid channels 62, the cooling media 64 exhausts back through the component for external processing, rather than flowing into the hot gas path 42.

In the particular embodiment shown in FIGS. 3 and 4, the component being cooled is a stationary vane 52 exposed to the hot gas path 42. The stationary vane 52 may include an outer flange 66 and an inner flange 68. The outer flange 66 may be configured to connect to a shroud segment (not shown) or other structure associated with the casing 40 to fixedly hold the stationary vane 52 in place. The outer and inner flanges 66, 68 combine to define at least a portion of the hot gas path 42, and an airfoil 70 sandwiched between the outer and inner flanges 66, 68 accelerates and redirects the combustion gases 24 to the next stage of rotating blades 50, as previously described with respect to FIG. 2. The airfoil 70 generally includes a leading edge 72, a trailing edge 74 downstream from the leading edge 72, and a concave surface 76 opposed to a convex surface 78 between the leading and trailing edges 72, 74, as is known in the art.

As shown in FIGS. 3 and 4, the system 60 may further include a supply plenum 80 and a return plenum 82 that alternately supply and exhaust the cooling media 64 to and from one or more cavities inside the stationary vane 52. Each fluid channel 62 may include an inlet port 86 and an outlet port 88 that provide a path for the cooling media 64 to flow into, through, and out of the fluid channels 62. The location of the fluid channels 62 and various inlet and outlet ports 86, 88 may provide numerous possible combinations of flow paths through the stationary vane 52. As a result, the cooling media 64 may provide convective and/or conductive cooling to the outer and inner flanges 66, 68 and/or the fluid channels 62 in the skin of the stationary vane 52 before exhausting through the return plenum 82.

Figure 5:
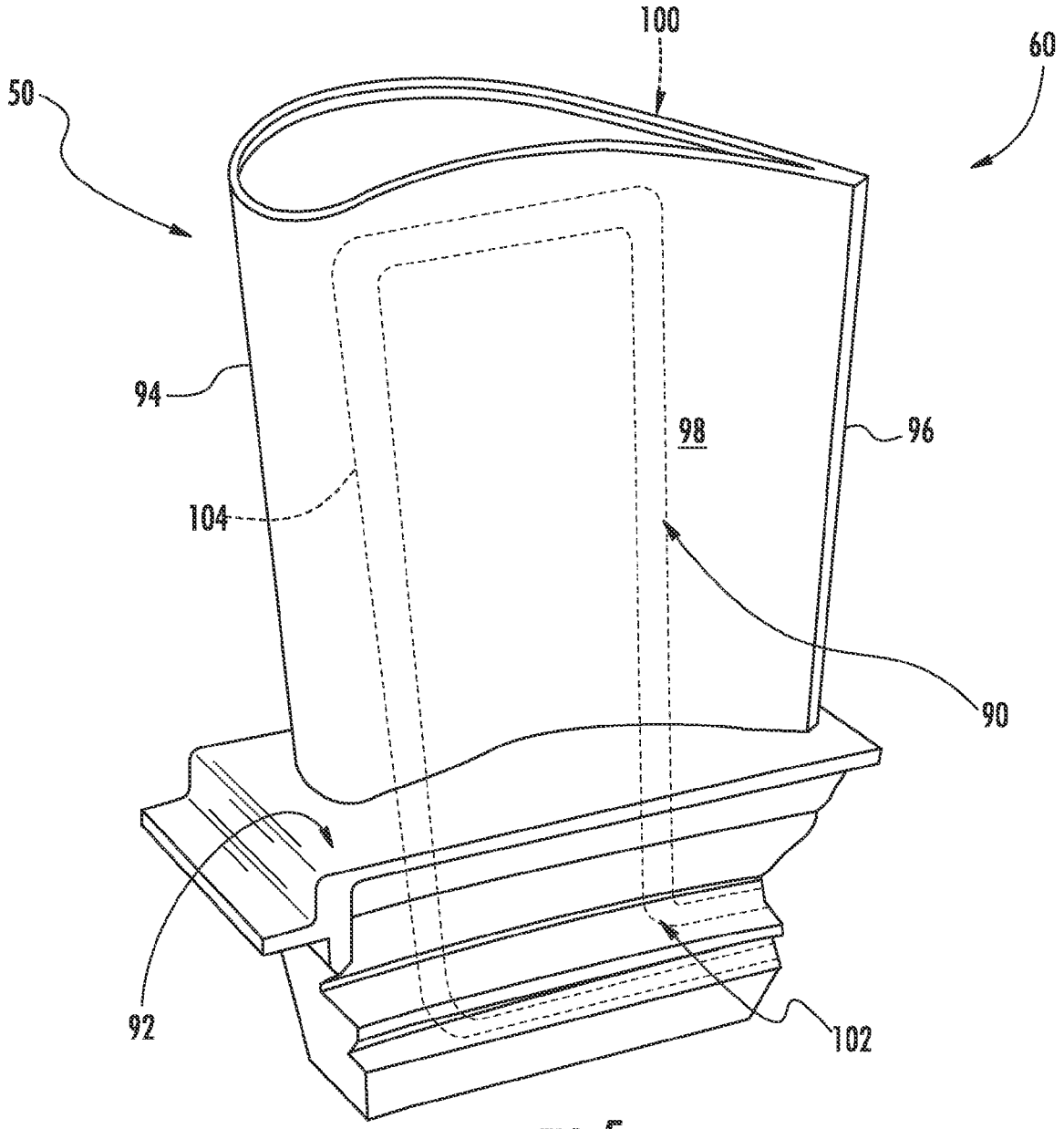
FIG. 5 is perspective view of the system for removing heat from the turbine according to an alternate embodiment of the present invention.
Figure 6:
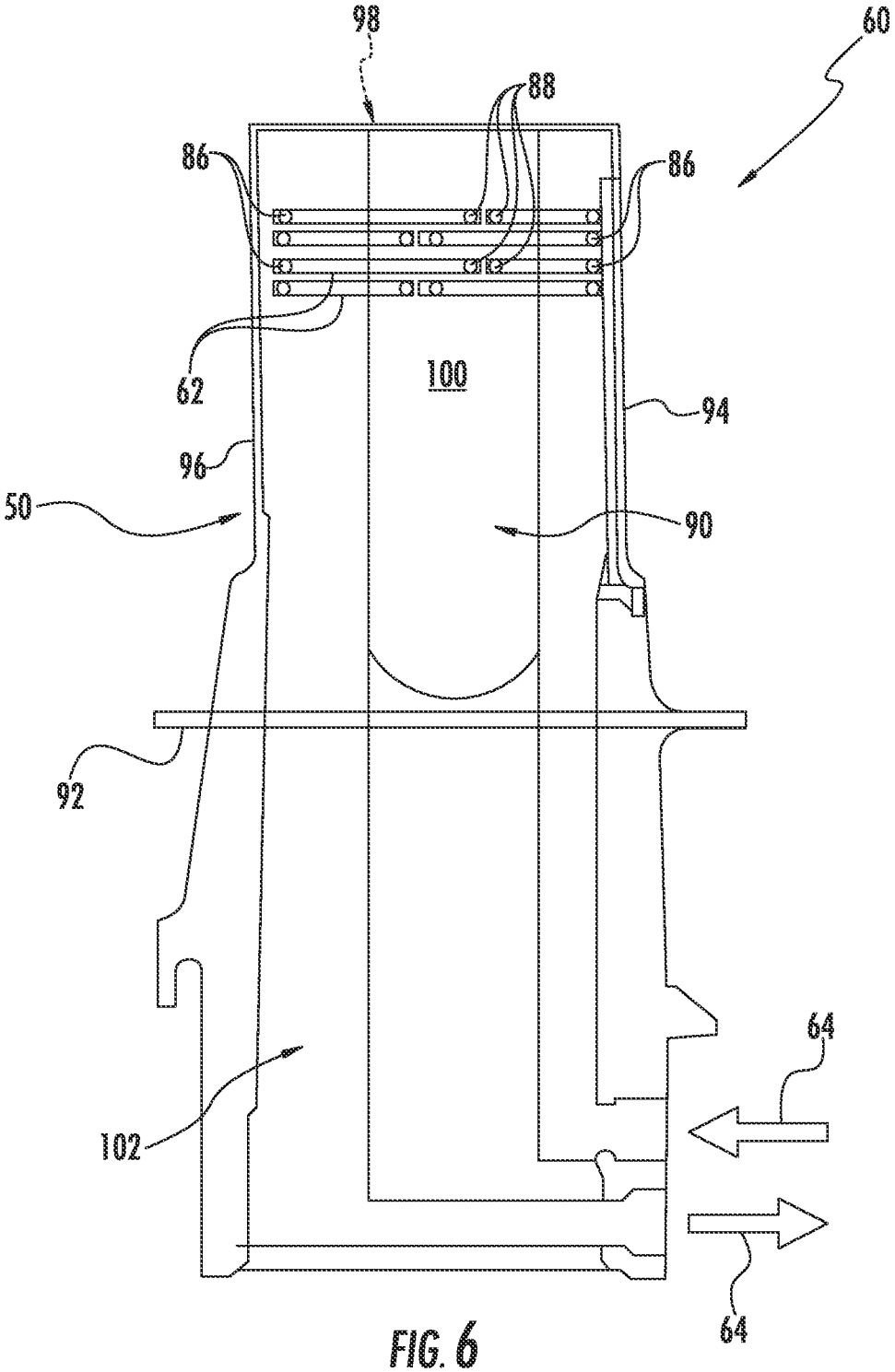
FIG. 6 is a plan view of the system shown in FIG. 5 with exemplary fluid channels and cooling media flow.

FIG. 5 provides a perspective view of the system 60 for removing heat from the turbine 26 according to an alternate embodiment of the present invention, and FIG. 6 provides a plan view of the system 60 shown in FIG. 5 with exemplary fluid channels 62 and cooling media flow 64. In this particular embodiment, the component being cooled is a rotating blade 50. The rotating blade 50 generally includes an airfoil 90 connected to a platform 92. The airfoil 90 has a leading edge 94, a trailing edge 96 downstream from the leading edge 94, and a concave surface 98 opposed to a convex surface 100 between the leading and trailing edges 94, 96, as previously described with respect to the stationary vane 52 shown in FIGS. 3 and 4. The platform 92 defines at least a portion of the hot gas path 42 and connects to a root 102. The root 92 in turn may slide into a slot in the rotor wheel 44 to radially restrain the rotating blade 50, as is generally known in the art.

As shown in FIGS. 5 and 6, the system 60 again includes one or more cavities 104 in the root 102 and airfoil 90 to supply and exhaust the cooling media 64 to and from the rotating blade 50. In addition, the location of the fluid channels 62 and various inlet and outlet ports 86, 88 may again provide numerous possible combinations of flow paths through the rotating blade 50. As a result, the cooling media 64 may provide convective and/or conductive cooling to the platform 92 and/or the fluid channels 62 in the skin of the rotating blade 50 before exhausting out of the root 102.

Figure 7:
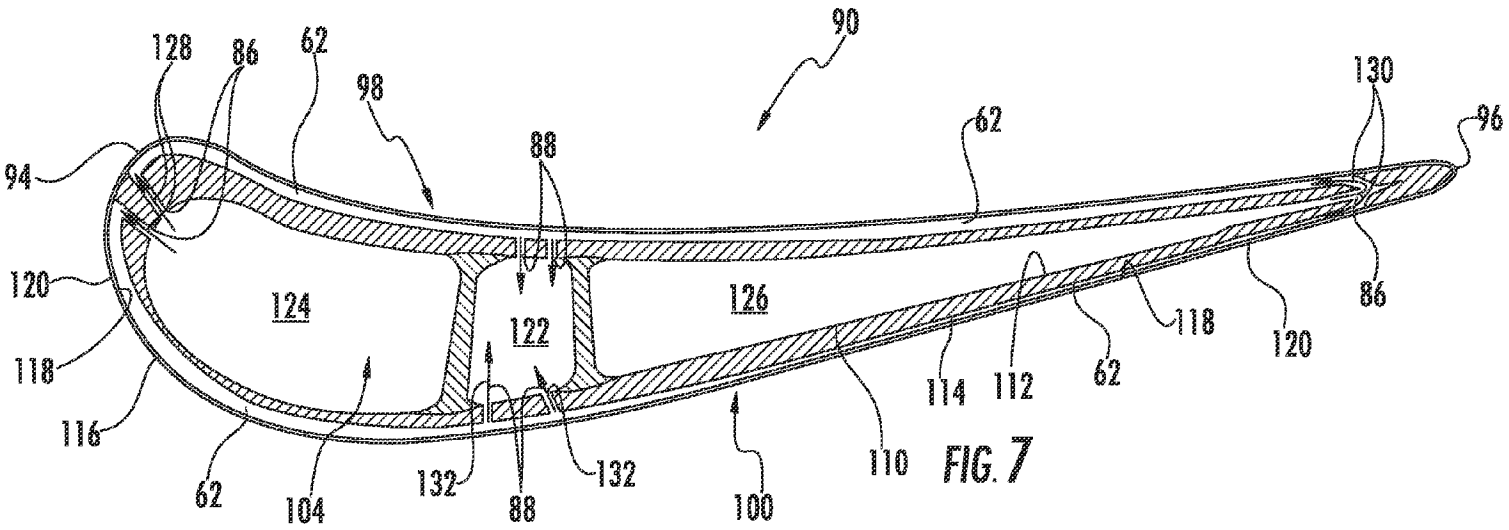
FIG. 7 is a cross-section view of an exemplary airfoil according to one embodiment of the present invention.
Figure 8:
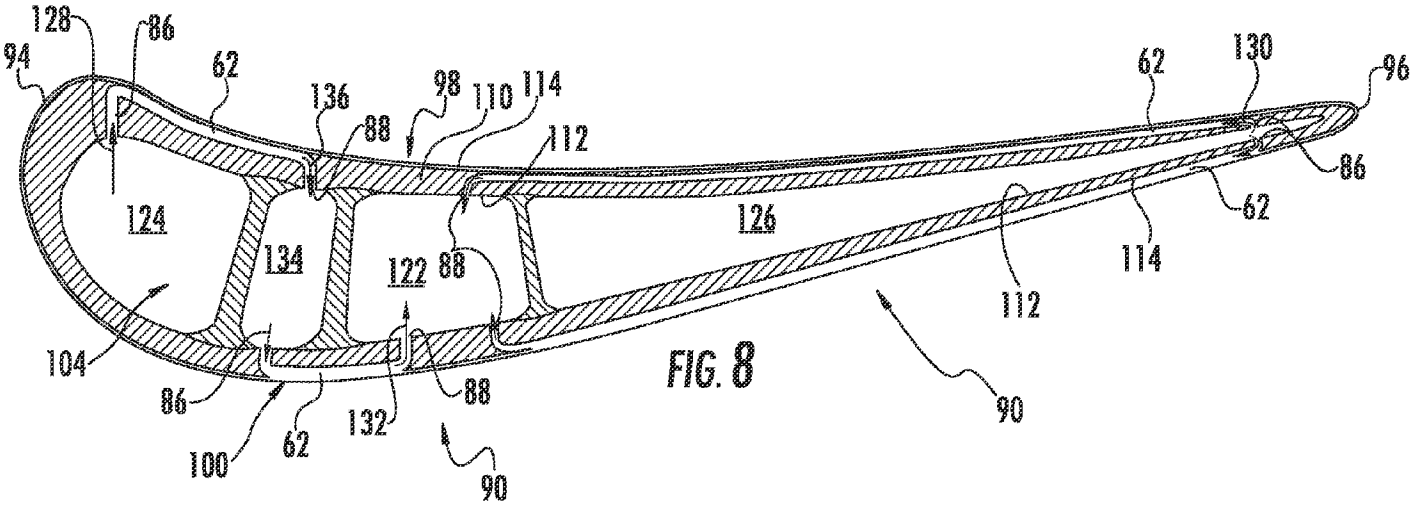
FIG. 8 is a cross-section view of an exemplary airfoil according to an alternate embodiment of the present invention.

FIGS. 7 and 8 provide cross-section views of an exemplary airfoil 90 that may be incorporated into the stationary vane 52 shown in FIGS. 3 and 4, and the illustrations and teachings may be equally applicable to the rotating blade 50 shown in FIGS. 5 and 6. As shown in each figure, a substrate 110 generally defines a shape of the airfoil 90, and the substrate 110 has an inner surface 112 facing the cavities 104 inside the airfoil 90 and an outer surface 114 facing the hot gas path 42. The substrate 110 may include nickel, cobalt, or iron-based superalloys that are cast, wrought, extruded, and/or machined using conventional methods known in the art. Examples of such superalloys include GTD-111, GTD-222, Rene 80, Rene 41, Rene 125, Rene 77, Rene N4, Rene N5, Rene N6, $4^{th}$ generation single crystal super alloy MX-4, Hastelloy X, and cobalt-based HS-188.

A coating 116 applied to the outer surface 114 of the substrate 110 has an interior surface 118 facing the outer surface 114 of the substrate 110 and an exterior surface 120 opposed to the interior surface 118 and exposed to the hot gas path 42. The coating 116 may include, for example, one or more bond coats and/or thermal barrier coatings, as will be described in more detail with respect to the particular embodiments shown in FIGS. 9-12. As shown in FIGS. 7 and 8, each fluid channel 62 is between the outer surface 114 of the substrate 110 and the exterior surface 120 of the coating 116. As a result, the fluid channels 62 provide a flow path for the cooling media 64 to flow through the skin of the airfoil 90 to convectively and/or conductively remove heat from the outer surface of the airfoil 90.

In the particular embodiment shown in FIG. 7, the airfoil 90 may include a return plenum 122 located between a forward supply plenum 124 and an aft supply plenum 126. At least one fluid channel 62 may extend between the leading and trailing edges 94, 96 inside both the concave and convex surfaces 98, 100 of the airfoil 90, and the locations of the inlet and outlet ports 86, 88 for each fluid channel 62 may provide numerous flow paths into and out of the fluid channels 62 across almost the entire outer surface of the airfoil 90. For example, the inlet ports 86 in the forward supply plenum 124 may provide a fluid path 128 from the forward supply plenum 124, through the substrate 110, and into the fluid channels 62 inside both the concave and convex surfaces 98, 100. Alternately, or in addition, the inlet ports 86 in the aft supply plenum 126 may provide another fluid path 130 from the aft supply plenum 126, through the substrate 110, and into the fluid channels 62 so that the cooling media 64 may flow from the trailing edge 96 toward the leading edge 94 inside the concave and convex surfaces 98, 100 of the airfoil 90. For either or both fluid paths 128, 130, the outlet ports 88 in the return plenum 122 may provide yet another fluid path 132 from the fluid channels 62, through the substrate 110, and into the return plenum 122. In this manner, the system 60 may provide cooling media flow 64 through the outer skin of the airfoil 90 in parallel, in either direction, and/or over substantially the entire outer surface of the airfoil 90.

In some embodiments, the system 60 may circulate the cooling media 64 through multiple fluid channels 62 in series before exhausting the cooling media 64 from the airfoil 90. As shown in FIG. 8, for example, the airfoil 90 may include an intermediate plenum 134 in addition to the return plenum 122, forward supply plenum 124, and aft supply plenum 126 previously described with respect to FIG. 7. In this particular embodiment, the fluid channel 62 in the concave surface 98 is upstream from the fluid channel 62 in the convex surface 100. Specifically, the inlet port 86 in the forward supply plenum 124 may provide the fluid path 128 from the forward supply plenum 124, through the substrate 110, and into the fluid channel 62 inside the concave surface 98. The outlet port 88 in the intermediate plenum 134 may then provide another fluid path 136 from the fluid channel 62, through the substrate 110, and into the intermediate plenum 134, and the inlet port 86 in the intermediate plenum 134 and the outlet port 88 port in the return plenum 122 may provide fluid communication for the cooling media 64 to flow through the fluid channel 62 inside the convex surface 100 before flowing into the return plenum 122 and out of the airfoil 90. The inlet ports 86 in the aft supply plenum 126 may provide the fluid path 130 from the aft supply plenum 126, through the substrate 110, and into the fluid channels 62 so that the cooling media 64 may flow from the trailing edge 96 toward the leading edge 94 along the concave and convex surfaces 98, 100 of the airfoil 90, as previously described with respect to FIG. 7.

FIGS. 9-12 provide enlarged cross-section views of various fluid channels 62 within the scope of various embodiments of the present invention. In each embodiment shown in FIGS. 9-12, the fluid channels 62 are either embedded in the substrate 110 and/or coating 116 or surrounded by the coating 116. As used herein, the term "embedded" means that only a portion of the fluid channel 62 is inside the identified structure and does not include a fluid channel 62 that is completely surrounded by the identified structure. U.S. Pat. Nos. 6,551,061 and 6,617,003 and U.S. Patent Publications 2012/0124832 and 2012/0148769, assigned to the same assignee as the present application, each disclose various systems and methods for manufacturing the fluid channels 62 shown in FIGS. 9-12, and the entirety of each patent and application is incorporated herein for all purposes.

Figure 9:
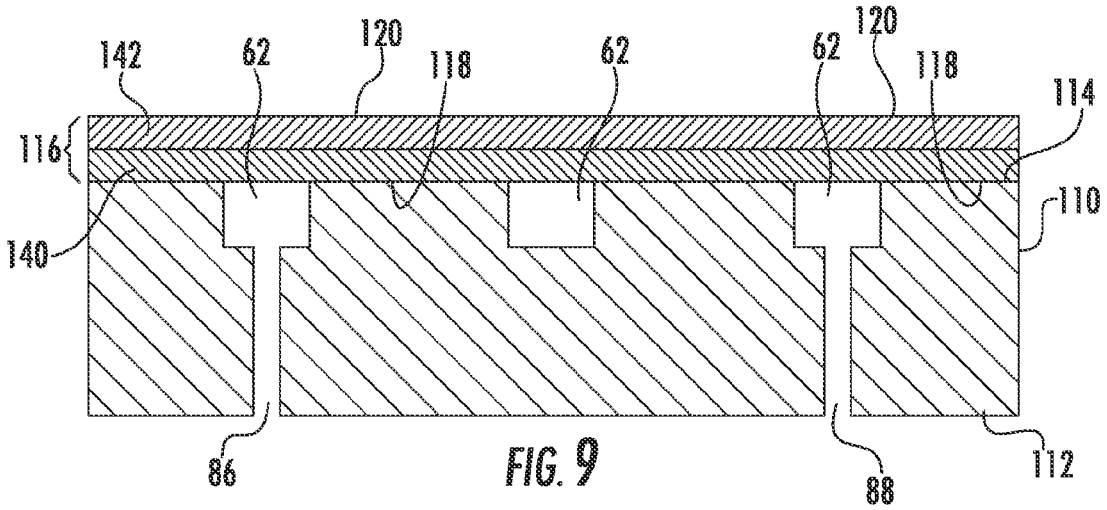
FIG. 9 is an enlarged cross-section view of fluid channels embedded in a substrate according to an embodiment of the present invention.

In the particular embodiment shown in FIG. 9, the fluid channels 62 are embedded in the outer surface 114 of the substrate 110, with the remaining portion of the fluid channels 62 covered by the coating 116. The fluid channels 62 and inlet and outlet ports 86, 88 may be formed or machined under the guidance or control of a programmed or otherwise automated process, such as a robotically controlled process, to achieve the desired size, placement, and/or configuration in the outer surface 114 of the substrate 110. For example, the fluid channels 62 and/or inlet and outlet ports 86, 88 may be formed in the outer surface 114 of the substrate 110 through laser drilling, abrasive liquid micro-jetting, electrochemical machining (ECM), plunge electrochemical machining (plunge ECM), electro-discharge machining (EDM), electro-discharge machining with a spinning electrode (milling EDM), or any other process capable of providing fluid channels 62 with desired sizes, shapes, and tolerances.

The width and/or depth of the fluid channels 62 may be substantially constant across the substrate 110. Alternately, the fluid channels 62 may be tapered in width and/or depth across the substrate 110. In addition, the fluid channels 62 may have any geometric cross-section, such as, for example, a square, a rectangle, an oval, a triangle, or any other geometric shape that will facilitate the flow of the cooling medium 64 through the fluid channel 62. It should be understood that various fluid channels 62 may have cross-sections with a certain geometric shape, while other fluid channels 62 may have cross-sections with another geometric shape. In addition, in certain embodiments, the surface (i.e., the sidewalls and/or floor) of the fluid channel 62 may be a substantially smooth surface, while in other embodiments all or portions of the fluid channel 62 may include protrusions, recesses, surface texture, or other features such that the surface of the fluid channel 62 is not smooth. Further, the fluid channels 62 may be specific to the component being cooled such that certain portions of the component may contain a higher density of fluid channels 62 than others. In some embodiments, each of the fluid channels 62 may be singular and discrete, while in other embodiments, one or more fluid channels 62 may branch off to form multiple fluid channels 62. It should further be understood that the fluid channels 62 may, in some embodiments, wrap around the entire perimeter of the component, with or without intersecting with other fluid channels 62.

One or more masking or filler materials may be inserted into the fluid channels 62 and inlet and outlet ports 86, 88 before the coating 116 is applied to the outer surface 114 of the substrate 110. The filler materials may include, for example, copper, aluminum, molybdenum, tungsten, nickel, monel, and nichrome materials having high vapor pressure oxides that sublimate when heated above 700 degrees Celsius. In other embodiments, the filler material may be a solid wire filler formed from an elemental or alloy metallic material and/or a deformable material, such as an annealed metal wire, which when mechanically pressed into the fluid channel 62 deforms to conform to the shape of the fluid channel 62. In other embodiments, the filler material may be a powder pressed into the fluid channel 62 to conform to the fluid channel 62 so as to substantially fill the fluid channel 62. Any portion of the filler materials that protrude out of the fluid channel 62 (i.e., overfill) may be polished or machined off prior to applying the coating 116 so that the outer surface 114 of the substrate 110 and the filler materials form a contiguous and smooth surface upon which subsequent layers and coatings 116 may be applied.

Once the outer surface 114 of the substrate 110 is suitably cleaned and prepared, one or more coatings 116 may be applied over the filler material and outer surface 14. As shown in FIG. 9, for example, the coating 116 may include a bond coat 140 applied to the outer surface 114 of the substrate 110 and a thermal barrier coating 142 applied to the bond coat 140. The bond coat 140 may be a diffusion aluminide, such as NiAl or PtAl, or a MCrAl(X) compound, where M is an element selected from the group consisting of iron, copper, nickel, and combinations thereof and (X) is an element selected from the group of gamma prime formers and/or solid solution strengtheners such as Ta, Re, and reactive elements, such as Y, Zr, Hf, Si, and grain boundary strengtheners consisting of B, C and combinations thereof. The thermal barrier coating 142 may include one or more of the following characteristics: low emissivity or high reflectance for heat, a smooth finish, and good adhesion to the underlying bond coat 140. For example, thermal barrier coatings 142 known in the art include metal oxides, such as zirconia ($ZrO_2$), partially or fully stabilized by yttria ($Y_2O_3$), magnesia (MgO), or other noble metal oxides. The selected bond coat 140 and thermal barrier coating 142 may be deposited by conventional methods using air plasma spraying (APS), low pressure plasma spraying (LPPS), or a physical vapor deposition (PVD) technique, such as electron beam physical vapor deposition (EB-PVD), which yields a strain-tolerant columnar grain structure. The selected bond coat 140 and/or thermal barrier coating 142 may also be applied using a combination of any of the preceding methods to form a tape which is subsequently transferred for application to the underlying substrate 110, as described, for example, in U.S. Pat. No. 6,165,600, assigned to the same assignee as the present invention. The bond coat 140 and/or thermal barrier coating 142 may be applied to a thickness of approximately 0.0005-0.06 inches, and the masking or filler materials may then be removed, such as by leaching, dissolving, melting, oxidizing, etching, and so forth, to leave the cross-section shown in FIG. 9.

Figure 10:
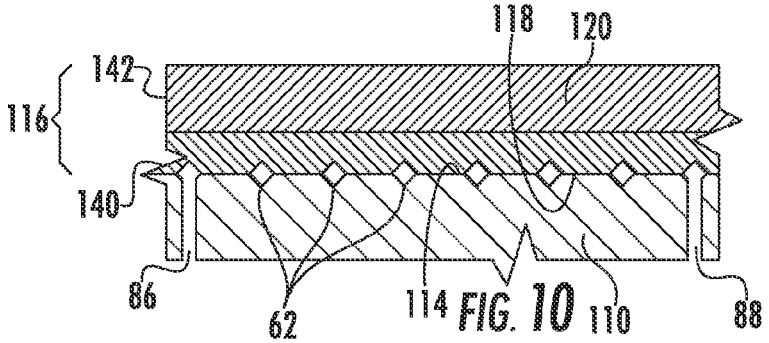
FIG. 10 is an enlarged cross-section view of fluid channels embedded in a coating according to another embodiment of the present invention.

FIG. 10 provides an enlarged cross-section view of fluid channels 62 embedded in both the outer surface 114 of the substrate 110 and the interior surface 118 of the coating 116 according to another embodiment of the present invention. In this embodiment, the fluid channels 62 and inlet and outlet ports 86, 88 may be machined into the outer surface 114 of the substrate 110 as previously described with respect to the embodiment shown in FIG. 9. The masking or filler materials may then be inserted into the fluid channels 62 and inlet and outlet ports 86, 88 to fill the fluid channels 62 and extend beyond the outer surface 114 of the substrate 110. The bond coat 140 and/or thermal barrier coating 142 may then be applied over the filler materials and outer surface 114 of the substrate 110 and the filler materials may be removed, as previously described with respect to FIG. 9, to leave the cross-section shown in FIG. 10.

Figure 11:
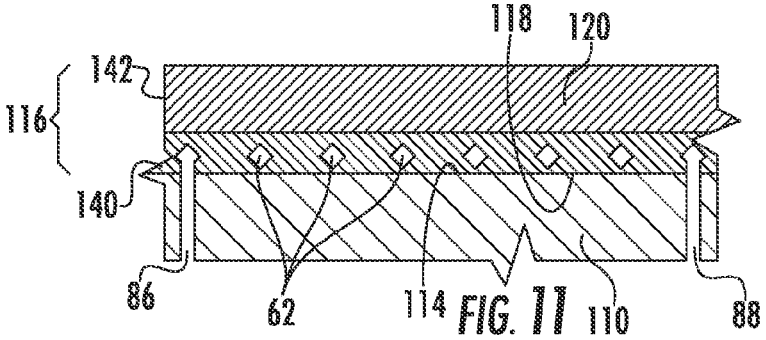
FIG. 11 is an enlarged cross-section view of fluid channels surrounded by a coating according to another embodiment of the present invention.

FIG. 11 provides an enlarged cross-section view of fluid channels 62 surrounded by the coating 116 according to another embodiment of the present invention. In this embodiment, one or more layers of the bond coat 140 may be applied to the relatively smooth substrate 110 as previously described with respect to FIG. 9. The masking or filler material may then be placed on or applied to the bond coat 140 and covered with one or more additional layers of the bond coat 140 and/or the thermal barrier coating 142, as previously described. The masking or filler material may then be removed as described above, leaving the fluid channels 62 wholly contained within the coating 116, as shown in FIG. 11.

Figure 12:
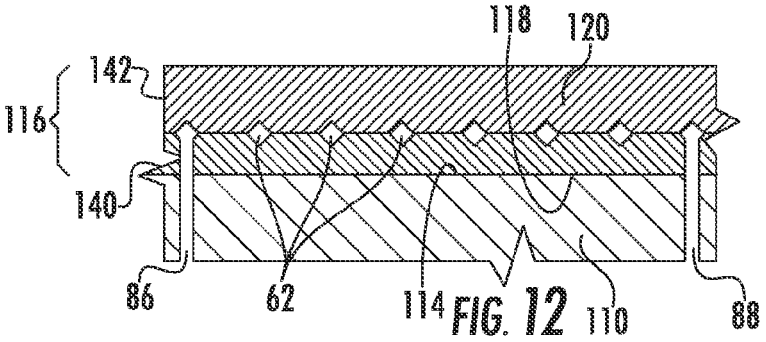
FIG. 12 is an enlarged cross-section view of fluid channels between a bond coat and a thermal barrier coating according to another embodiment of the present invention.

FIG. 12 provides an enlarged cross-section view of fluid channels 62 between the bond coat 140 and the thermal barrier coating 142 according to another embodiment of the present invention. This embodiment is produced in much the same manner as the embodiment previously described and illustrated in FIG. 11, except the masking or filler material is applied between the application of the bond coat 140 and the thermal barrier coating 142. The resulting fluid channels 62 are thus embedded in both the bond coat 140 and the thermal barrier coating 142, as shown in FIG. 12

The various embodiments shown and described with respect to FIGS. 1-12 may also provide a method for removing heat from the turbine 26. The method may include, for example, flowing the cooling media 64 through the supply plenum 80 into one or more components along the hot gas path 42. The method may further include flowing the cooling media 64 through one or more fluid channels 62 located between the outer surface 114 of the substrate 110 and the exterior surface 120 of the coating 116 before exhausting the cooling media 64 from the component through the return plenum 82. In particular embodiments, the method may flow the cooling media 64 through the fluid channels 62 in parallel or series.

One of ordinary skill in the art will readily appreciate from the teachings herein that the systems 60 and methods described herein may remove heat from the turbine 26 without requiring film cooling over the components along the hot gas path 42. As a result, operating temperatures in the turbine 26 may be increased without introducing aerodynamic mixing losses associated with film cooling. In addition, the closed-loop cooling requires substantially less cooling media 64 compared to conventional film cooling systems, and the heat removed from the turbine 26 by the closed-loop cooling may be retained in the overall cycle or recaptured by an off-board system to enhance overall plant efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A stationary vane for a turbine of a gas turbine, the stationary vane comprising:

an inner flange radially spaced from an outer flange;

an airfoil that extends radially between the inner flange and the outer flange, wherein the airfoil is at least partially formed from a substrate and a coating applied to an outer surface of the substrate, wherein the coating has an interior surface facing the outer surface of the substrate and an exterior surface opposed to the interior surface, wherein the airfoil defines a first cavity and a second cavity within the substrate;

a supply plenum that extends through the outer flange, wherein the supply plenum is in fluid communication with the first cavity;

a return plenum that extends through the outer flange, wherein the return plenum is in fluid communication with the second cavity;

a first fluid channel defined between the outer surface of the airfoil substrate and the exterior surface of the coating, wherein the supply plenum, the first cavity, the first fluid channel, the second cavity and the return plenum define a flow path for routing a cooling media into and hack out of the airfoil through the outer flange.

2. The stationary vane as in claim 1, wherein the coating comprises a bond coat applied to the outer surface of the airfoil substrate and a thermal barrier coating applied to the bond coat and wherein the first fluid channel is defined between the bond coat and the thermal barrier coating.

3. The stationary vane as in claim 1, wherein the first fluid channel is embedded in the outer surface of the substrate, and the first fluid channel is embedded in the interior surface of the coating.

4. The stationary vane as in claim 1, wherein the first fluid channel is surrounded by the coating.

5. The stationary vane as in claim 1, wherein the first fluid channel includes an inlet port and an outlet port, wherein the inlet port defines a flow path from the first cavity into the first fluid channel and the outlet port defines a flow path between the first fluid channel and the second cavity.

6. The stationary vane as in claim 1, further comprising a second fluid channel defined between the outer surface of the airfoil substrate and the exterior surface of the coating, wherein an inlet port. of the second fluid channel is in fluid communication with an outlet port of the first fluid channel and an outlet port of the second fluid channel is in fluid communication with the second cavity.

7. The stationary vane as in claim 6, wherein the coating comprises a bond coat applied to the outer surface of the airfoil substrate and a thermal barrier coating applied to the bond coat and wherein the second fluid channel is defined between the bond coat and the thermal barrier coating.

8. The stationary vane as in claim 1, wherein the airfoil substrate defines a third cavity downstream from the first fluid channel and upstream from the second cavity.

9. The stationary vane as in claim 8, wherein an outlet port of the first fluid channel is in fluid communication with the third cavity.

10. The stationary vane as in claim 8, further comprising a second fluid channel defined between the outer surface of the airfoil substrate and the exterior surface of the coating, wherein an inlet port of the second fluid channel is in fluid communication with the third cavity and an outlet port of the second fluid channel is in fluid communication with the second cavity.

11. The stationary vane as in claim 8, further comprising a second fluid channel defined between the outer surface of the airfoil substrate and the exterior surface of the coating, wherein an outlet port of the first fluid channel is in fluid communication with the third cavity, an inlet port of the second fluid channel is in fluid communication with the outlet port of the first fluid channel via the third cavity and an outlet port of the second fluid channel is in fluid communication with the second cavity.

12. A rotating blade, comprising:

a platform;

a root that extends radially inwardly from the platform;

an airfoil that extends radially outwardly from the platform, the airfoil including a leading edge, a trailing edge a concave pressure side surface and a convex suction side surface, wherein the airfoil is at least partially formed from a substrate and a coating applied to an outer surface of the substrate, wherein the coating has an interior surface facing the outer surface of the substrate and an exterior surface opposed to the interior surface, wherein the airfoil defines a forward supply plenum and an aft supply plenum in fluid communication with a cooling media inlet defined in the root of the airfoil and a return plenum in fluid communication with a cooling media outlet defined in the root of the airfoil;

a first fluid channel defined between the outer surface of the airfoil substrate and the exterior surface of the coating, wherein the first fluid channel is in fluid communication with at least one of the forward supply plenum and the aft supply plenum and with the return plenum to define a closed flow path for routing a cooling media from the cooling media inlet, through the airfoil and out of the cooling media outlet.

13. The rotating blade as in claim 12, wherein the coating comprises a bond coat applied to the outer surface of the airfoil substrate and a thermal barrier coating applied to the bond coat, wherein the first fluid channel is defined between the bond coat and the thermal barrier coating.

14. The rotating blade as in claim 12, wherein the first fluid channel is in fluid communication with both the forward supply plenum and the aft supply plenum via a plurality of inlets defined by the airfoil substrate.

15. The rotating blade as in claim 12, wherein the first fluid channel extends beneath at least one of the convex suction side surface and the concave pressure side surface of the airfoil.

16. The rotating blade as in claim 12, wherein the airfoil further defines an intermediate plenum downstream from the first fluid channel and a second fluid channel defined between the outer surface of the airfoil substrate and the exterior surface of the coating, wherein the second fluid channel defines a flow path between the intermediate plenum and the return plenum.

17. The rotating blade as in claim 16, wherein the second fluid channel extends beneath the convex suction side surface of the airfoil.

18. The rotating blade as in claim 16, wherein the first fluid channel extends beneath the concave pressure side surface of the airfoil.

19. The rotating blade as in claim 16, further comprising a third fluid channel defined between the outer surface of the airfoil substrate and the exterior surface of the coating, wherein the third fluid channel defines a flow path between the aft supply plenum and the return plenum.

20. The rotating blade as in claim 19, wherein the third fluid plenum extends beneath at least one of the convex suction side surface and the concave pressure side surface of the airfoil.

* * * * *